US005265741A

United States Patent [19]

Shimizu et al.

[11] Patent Number: 5,265,741

[45] Date of Patent: Nov. 30, 1993

[54] BOOM EXTENSION FOR GANTRY CRANES

[75] Inventors: Yuzo Shimizu, San Mateo; Hans G. Vosskamp; Yuksel Yildirim, both of Foster City, all of Calif.

[73] Assignee: Paceco Corp., San Mateo, Calif.

[21] Appl. No.: 928,946

[22] Filed: Aug. 11, 1992

[51] Int. Cl.[5] ..... B66C 23/70

[52] U.S. Cl. ..... 212/177; 212/178; 212/197; 212/270; 212/219

[58] Field of Search ..... 212/219, 177, 197, 198, 212/178, 270, 175, 187

[56] References Cited

U.S. PATENT DOCUMENTS 694,383 3/1902 Hulett ..... 212/219

4,762,240 8/1988 Thompson ..... 212/219

FOREIGN PATENT DOCUMENTS 501510 10/1928 Fed. Rep. of Germany ..... 212/219

*Primary Examiner*—David A. Bucci
*Assistant Examiner*—Thomas J. Brahan
*Attorney, Agent, or Firm*—Bruce & McCoy

[57] ABSTRACT

An apparatus and method for providing a boom extension for retractable booms of gantry cranes which does not require lowering the boom during attachment of the extension, or increasing the lift capacity of the boom hoist machinery, nor does the boom extension add bending moment to the retractable boom.

12 Claims, 3 Drawing Sheets

BOOM EXTENSION FOR GANTRY CRANES

BACKGROUND OF THE INVENTION

1. Field of the Invention

The present invention relates to apparatus and methods for providing a boom extension for gantry cranes having a retractable boom which in its operating position extends outboard from the crane superstructure in a horizontal orientation and which can be pivoted about its inboard end at its attachment point to the crane superstructure by boom hoist ropes to an upward projecting retracted position. More particularly, the present invention relates to a retrofit for existing cranes that does not require lowering the retractable boom to ground level to attach the boom extension to the outboard end of the retractable boom, nor does it require increasing the lift capacity of the boom hoist machinery to hoist the retractable boom and boom extension combination to its retracted position, nor does it require strengthening the retractable boom to carry a larger bending moment due to the increased loading created by the dead weight of the boom extension.

2. Description of the Prior Art

Rail mounted dockside gantry cranes having retractable booms have long been used, and are the standard in the industry, for loading and unloading containerized cargo and fungible bulk materials between waterborne vessels and dockside transportation equipment. The retractable boom in its operating position extends horizontally outboard from the crane superstructure and in its retracted position clears any ship berthed alongside the dock adjacent the crane. When a ship is berthed alongside a dock, the gantry crane is moved along the dock parallel the ship to a position where the retractable boom can be extended across the beam of a ship above the ship's cargo-carrying areas. The cargo can then be transported between a dockside deposition area and any storage position located within the ship's holds or on the ship's deck.

In the particular form of gantry crane to which the present invention pertains, the retractable boom is pivotable about its inboard end at its attachment point to the crane superstructure. Boom hoist ropes raise the boom to an upward projecting retracted position. This permits a ship to be moved forward or backward alongside the dock during berthing or departure without mechanical interference with the dockside crane when the boom is retracted. Likewise, it also permits the crane to be moved fore and aft along the ship with the boom retracted to reposition the boom to service the different cargo-carrying areas of the ship without the crane hitting the vessel's superstructure or rigging when the crane is moved.

As the sea-going vessels which carry containerized or fungible bulk cargos have become larger to satisfy the economics of international trade, their beam width has been increased to accommodate a greater number of containers or larger amounts of fungible bulk materials athwartships. To effectively and efficiently load and unload such vessels, it has become necessary to extend the operational outreach of the dockside cranes so the containers or bulk materials can be deposited or retrieved from said vessels at the furthest athwartship locations relative to the dock.

Many existing dockside gantry cranes do not have the required outreach for servicing these newer vessels but are capable of handling the increase in weight of a loaded boom with an extension. It therefore is obviously desirable to provide a means to effect an increase in the length of such present gantry crane booms rather than to replace the whole crane.

Extensions of gantry crane operational outreach have been accomplished by utilizing a boom whose length has been increased from a nominal 125 feet to a length of 155 feet. With such an extension, the weight of the boom will be increased by as much as 20 tons which generally requires an increase in the overall structural strength and rebalance of the total crane structure to safely support the increase in the crane's total dead weight due to extended boom length. It is necessary to counter the increased tipping torque created by the added weight of the boom extension and the increased distance the suspended loads can be moved outboard from the crane superstructure.

In most retrofit boom conversions, it has been necessary to lower the existing boom to ground level, extend its overall length by the conventional means of adding a boom extension section, increase the strength of the original boom to resist the increased bending moment imposed on the original boom by the extension, and to lift the modified boom and reattach it to the crane superstructure. Retractable booms are typically located approximately 80 feet or more above dock level and can weigh generally between 60 to 100 tons. Lowering such a boom from such a height requires a substantial lift capacity and high lift capability of auxiliary erection equipment which is not always available and invariably is very expensive.

In making such a conversion, it is also usually necessary to at least increase the boom hoist machinery lift capacity and the boom hoist rope lifting strength. The weight of the boom extension severely overloads the boom hoist apparatus especially as a result of the boom extension being added to the outboard end of the original boom.

In order to accomplish these retrofits, it is necessary to effect a complete shutdown of the operation of the crane for an extended period of time and to incur the expense of heavy-duty lift machinery and auxiliary erection equipment to lower and lift the large structural components to effect the conversion. A substantial period of down time on the order of two to three months or more is required to effect the modifications and return the crane to operating condition.

The present invention provides a way of avoiding the necessity of making the main expensive modifications, of greatly shortening the time required to make the conversion, and of substantially reducing the cost involved for heavy lift erection equipment.

The present invention is an apparatus and method for modifying presently existing gantry cranes to provide a boom extension without the necessity of lowering the retractable boom to ground level to add the new boom section; without increasing the strength of the retractable boom to carry additional bending moment; without increasing the lift capacity of the boom hoist rope machinery or the strength of the boom hoist ropes; and the conversion can be accomplished in far less time and with far less additional lift capacity than heretofore required by contemporary conversion means and methods.

SUMMARY OF THE INVENTION

The present invention is a boom extension for a gantry crane having a retractable boom which in its operating position extends outboard from the crane superstructure in a horizontal orientation and which can be pivoted about its inboard end at its attachment point to the superstructure by boom hoist ropes to an upward projecting retracted position. The boom extension apparatus comprises a section of boom secured to the outboard end of the retractable boom as a boom extension in a manner which does not add bending moment to the retractable boom. A forestay is secured between the crane superstructure and the boom extension to carry the vertical load. A counterweight is mounted on the crane superstructure and formed to reciprocate between limits. One of the limits is defined by the retractable boom being disposed in its lowered operating position. The other limit is defined as when the retractable boom with the boom extension attached thereto has been raised to a point during retraction of the boom where the load on the boom hoist ropes for lifting the retractable boom and boom extension combination is approximately equal to the load which would be imposed on the boom hoist ropes alone at the commencement of boom retraction without the boom extension attached to the outboard end of the retractable boom. At least one auxiliary hoist rope is secured between the retractable boom and boom extension combination and the counterweight, and it is reeved over a sheave mounted on the crane superstructure at a point above the vertical location of the retractable boom on the superstructure. The auxiliary boom hoist rope provides a lift force on the retractable boom and boom extension combination while the retractable boom is being raised or lowered and the counterweight is raised above its lower limit.

The present invention also includes as a separate invention a supplemental hoist mechanism for use on any type of similar gantry crane having a retractable boom. The invention is comprised of simply the limited movement counterweight which is connected to the boom by the auxiliary hoist rope. The counterweight provides lift force through the auxiliary boom hoist rope which is not connected to or driven by the boom hoist rope drive machinery. The counterweight provides a lift force on the retractable boom during only a portion of the cycle while the boom is being raised or lowered. The lift force is supplied by the counterweight through the auxiliary hoist rope at least while the combined load on the boom hoist ropes and auxiliary hoist rope is approximately equal to or greater than a preselected load on the boom hoist ropes alone.

The present invention also includes the method of providing a retrofit boom extension for the same type of gantry cranes without removing the retractable boom from the crane and without requiring additional lift capacity in the boom hoist machinery or the boom hoist ropes utilized for retracting the boom. It comprises securing a new section of boom to the outboard end of the existing retractable boom in a manner which does not add bending moment to the retractable boom when the boom extension is supporting a load, supporting the boom extension by additional forestays, and supporting the additional load imposed by the boom extension on the boom hoist machinery and hoist ropes by a movable counterweight connected t the retractable boom and boom extension combination by an auxiliary hoist rope reeved over a sheave mounted on the crane superstructure at a point above the vertical location of the retractable boom on the superstructure.

The present invention further includes a method for retrofitting a boom extension to a gantry crane having a boom which in its operating position extends outboard from the crane superstructure in a horizontal orientation without imposing any appreciable bending movement on the main boom when the boom extension is supporting a load. The method comprises securing a new section of boom to the outboard end of the existing boom with a pivot connection which permits the boom extension to rotate downward slightly from the horizontal operating position of the main boom when the boom extension is supporting a load, supplying stops to prevent the boom extension from rotating upward with respect to the main boom beyond a preselected limit, and supporting the boom extension from the crane superstructure by additional forestays to carry the vertical load thereof.

OBJECTS OF THE INVENTION

It is therefore an important object of the present invention to provide a new and novel method and apparatus for retrofitting an extended length to a retractable boom on a gantry crane.

It is another object of the present invention to provide a method and apparatus for providing a boom extension retrofit for a retractable boom of a gantry crane that does not require the boom to be lowered to the ground for the modifications to be effected.

It is a further object of the present invention to provide a method and apparatus for providing a boom extension retrofit for a retractable boom of a gantry crane that can be retracted by the original boom hoist apparatus which do not require additional hoist rope drive machinery capacity or increased strength in the boom hoist ropes.

It is still another object of the present invention to provide additional hoist capacity for a gantry crane having a retractable boom which pivots about its inboard end, and is raised by boom hoist ropes, by means of a counterweight which acts only between limits during a portion of the retraction and lowering cycles.

It is still a further object of the present invention to provide a means for modifying a conventional gantry crane to an extended boom configuration with a minimum of loss of operational time.

It is yet another object of the present invention to provide a supplemental hoist mechanism for a gantry crane to help lift the load of the retractable boom during hoisting for a pre-selected portion of the boom hoist cycle.

And it is yet a further object of the present invention to provide a method for adding a boom extension to a gantry crane that does not impose additional bending movement of the original boom.

Other objects and advantages of the present invention will become apparent when the apparatus and methods of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
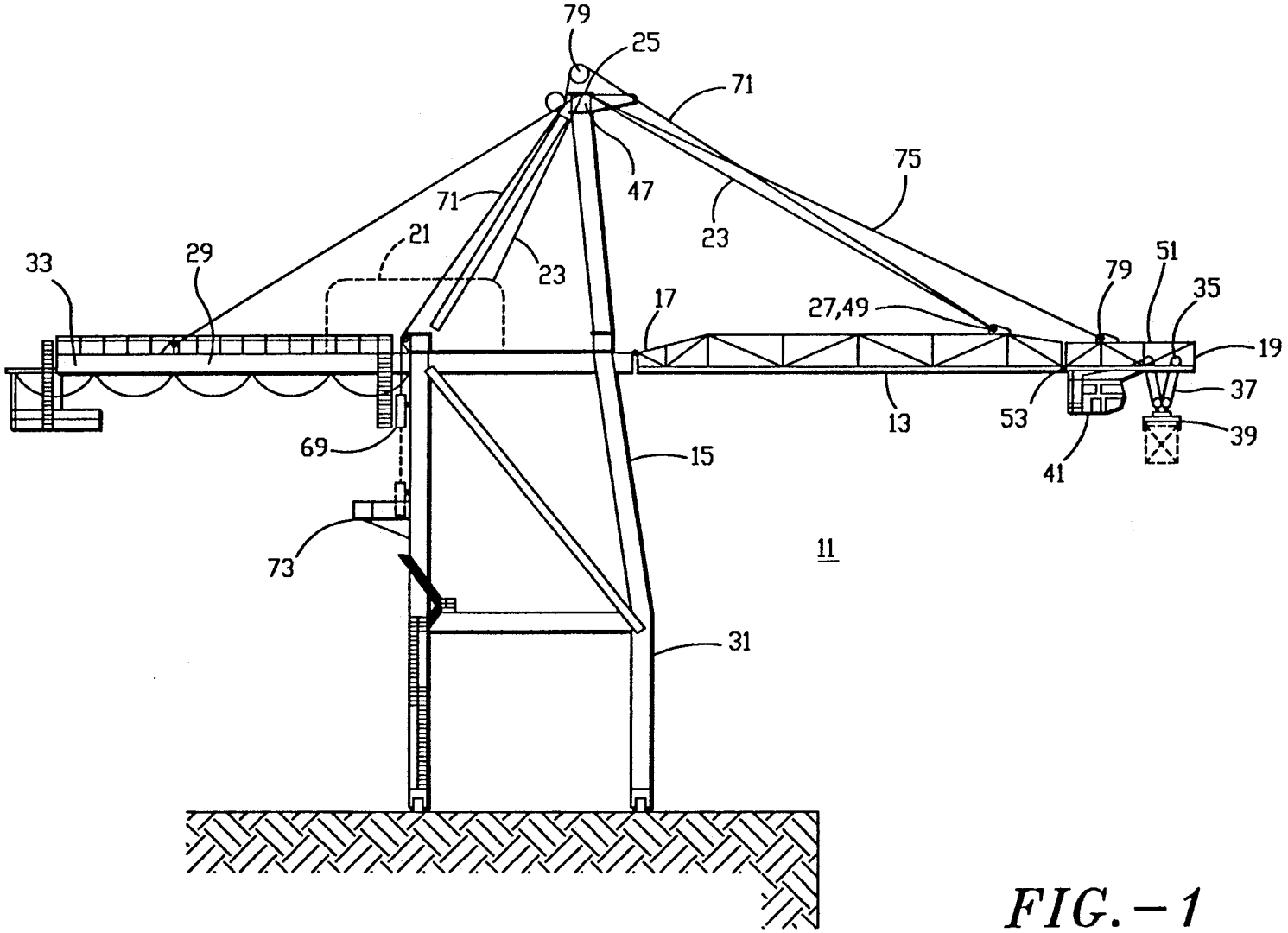
FIG. 1 is a side elevation view of a gantry crane with a boom extension of the present invention secured thereto.
Figure 2:
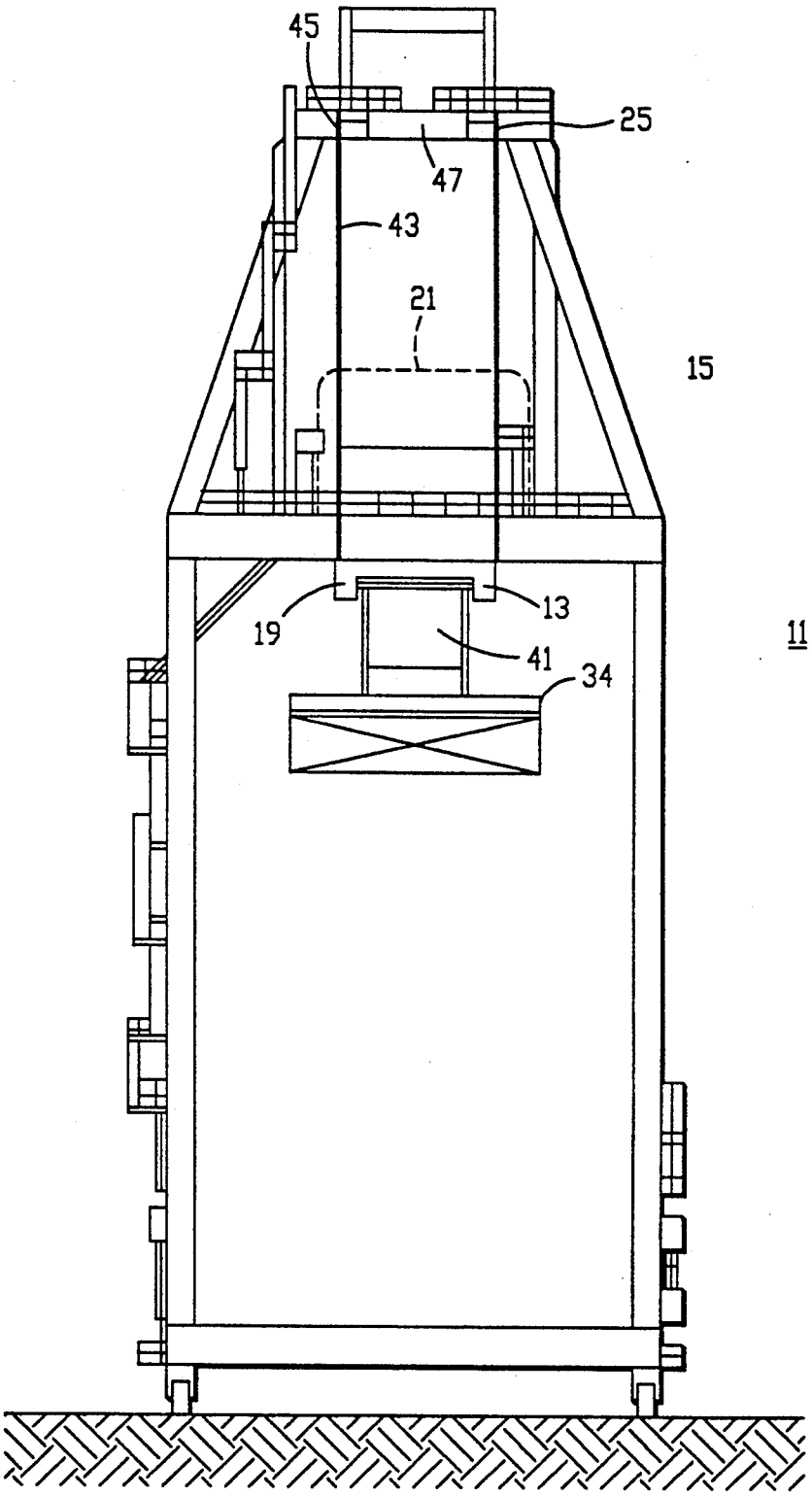
FIG. 2 is a front elevation of the gantry crane of FIG. 1.

Reference is made to FIGS. 1 and 2 of the drawings which illustrate a typical rail mounted dockside gantry crane cargo loader and unloader for container, grab bucket, or bulk material handling. A portion of the structure is broken away for clarity to show the added parts. The crane 11 has a retractable boom 13 which extends outboard from the crane superstructure 15 in a horizontal orientation when the boom is disposed in its operating position. The elevated positioning of the boom on the superstructure permits the boom to extend across the beam of cargo vessels. The inboard end 17 of the boom is called the landside end, and the outboard end 19 of the boom, which extends over the ship, is called the waterside end.

The boom 13 can be retracted to an upward projecting stowed position to permit the ship to move into and out of its moored or berthed position at dockside. With the boom retracted, the crane 11 can also move along the ship's side to the various cargo deposition areas aboard ship without the risk of interference or collision of the boom with the ship's superstructure. The retraction is accomplished by pivoting the retractable boom about its inboard end 17 at its attachment point to the crane superstructure 15. The retraction cycle is accomplished by boom hoist apparatus which includes drive machinery in the form of drive motors and wire rope hoist drums, which are mounted in the machinery house 21, and boom hoist ropes 23 which pass out of the machinery house and up over sheaves 25 (not shown) mounted at the top of the gantry crane superstructure. The ropes are secured to attachment points 27 on the retractable boom.

The gantry crane 11 has a trolley girder 29 similar in construction to the retractable boom 13 and which is permanently affixed to the crane's superstructure 15. It extends rearward over the railroad tracks or truck marshalling yards disposed under the landside portion of the crane for the deposition or pickup of materials. Its length is measured from the waterside upper leg 31 of the crane superstructure to the extreme overhang end 33 or the landside end of the trolley girder.

A pair of trolley rails are affixed to and extend along the length of the trolley girder 29 and the retractable boom 13 and support a trolley platform 35 which traverses the tracks on wheels. The trolley is propelled along the length of the girder and boom by wire ropes which are driven by wire rope drive machinery also located in the machinery house 21. In the case of a cargo container handling crane, the trolley supports fleet-through sheaves for the load lifting wire ropes 37 which suspend a cargo container lifting spreader 39 below the trolley. An operator's cab 41 is attached to and moves with the trolley along the girder and boom.

The machinery house 21 encloses all the necessary and conventional drive machinery and controls to effect the operation of the hoist machinery for the boom 13, the drive machinery for the trolley 35, and the lift machinery for the load lifting wire ropes 37.

A pair of foldable boom forestays 43 (not shown in FIG. 1 for clarity) support the weight of the retractable boom 13 when it is disposed in its horizontal operating position. The inboard ends 45 of the forestays are anchored at an uppermost or cross-tie beam 47 portion of the crane superstructure 15, and the outboard ends 49 of the forestays are secured to the upper chordal members of the retractable boom. The forestays are usually rigid links which fold in predetermined patterns which avoid mechanical interference with any other portions of the crane superstructure.

Standard conventional drive means are utilized for moving the crane along the dockside tracks and for the overall general safe and continuous operation of the crane in its loading and unloading servicing modes as well as for deactivation of the crane into nonoperational or stowed conditions.

The present invention relates to methods and apparatus which allow existing operational dockside container handling gantry cranes with a boom having insufficient outreach to have it extended without rebuilding the boom, without having to lower the boom to ground level, and without the necessity of changing the capacity of the existing boom hoisting apparatus. The invention allows the modification to be made on site with a minimum of additional required lift capacity and a substantially reduced down time.

In order to accomplish the modification, a short section of the existing boom tip needs to be removed and a boom extension 51 added which includes the conventional rails on which the trolley travels to the outboard end 19 of the new extension. The extension is secured with a simple pivot connection 53, and the trolley drive rope equalizer sheave assembly and the trolley abutment stops, removed from the discarded original boom tip, are reinstalled in the new boom extension.

Figure 3:
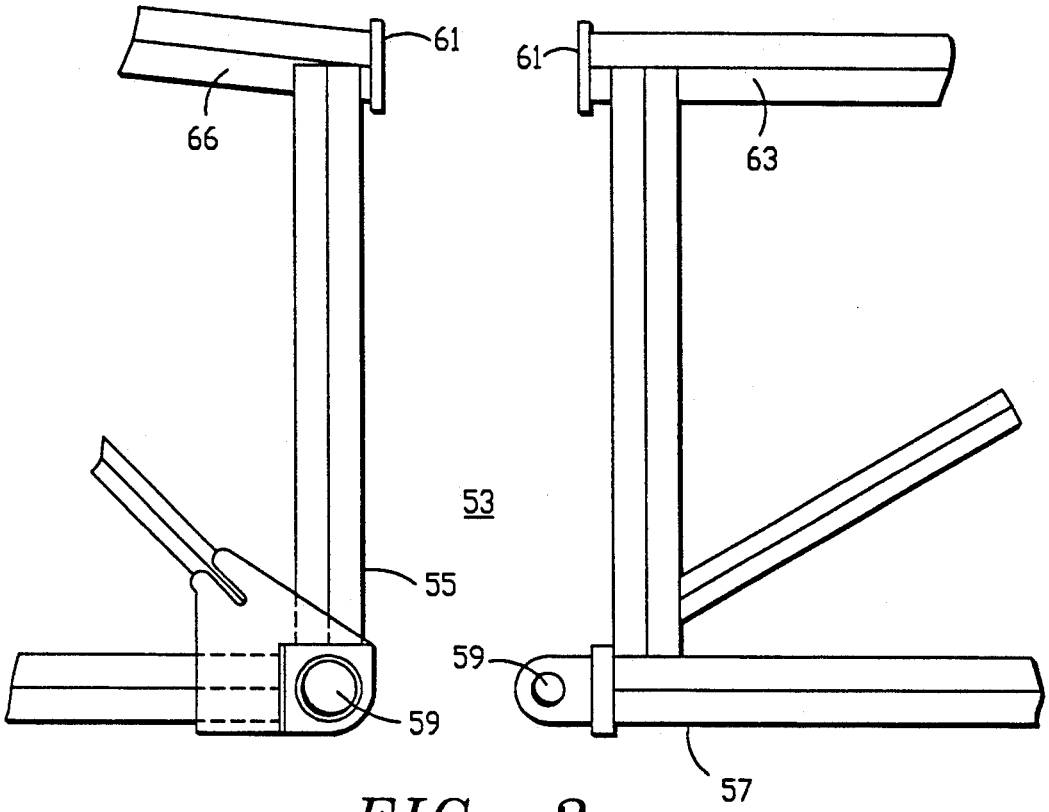
FIG. 3 is a detail exploded view in side elevation of the connection ends of the boom and boom extension.

Reference is made to FIG. 3 of the drawings. The boom extension 51 is a section of boom, essentially identical in cross-section to the retractable boom 13 and of the desired length, which is secured to the outboard end of the retractable boom in a manner which does not add any appreciable bending moment to the retractable boom. This is accomplished in the preferred embodiment of the invention by securing the boom extension to the retractable boom with a pivot connection 53 which permits the boom extension to rotate downward slightly from the horizontal operating position of the retractable boom 13 when the boom extension is carrying a load. The pivot connection is disposed between the lower outboard end 55 of the retractable boom and the lower inboard end 57 of the boom extension and is comprised of simply two spherical bearings 59 which are interlocked by a pin member (not shown). This pivot connection makes it very simple and fast to secure the new section to the retractable boom.

Stops 61 are provided to prevent the boom extension 51 from rotating upward with respect to the retractable boom 13 beyond a preselected limit In the preferred embodiment of the invention, the upper inboard end 63 of the boom extension is provided with abutment stops 61 which are formed to bear against similar abutment stops formed on the outboard upper end 65 of the retractable boom. The abutment stops are compressible resilient bumpers which absorb any contact which occurs such as when the boom is raised to an upward projecting position and wind-induced loading causes further upward rotational motion of the boom extension section. A captive latching means (not shown) is provided to limit the separation of the boom extension section from its juxtaposed position with the upper end of the retractable boom when the raised boom is subjected to wind-induced rotation in a downward direction with respect to the retractable boom.

Reference is again made to FIGS. 1 and 2 of the drawings. A counterweight 69 is mounted on the crane superstructure 15 and formed to reciprocate between limits to provide additional lift force to raise the retractable boom 13 during a portion of the retraction cycle. One limit of movement is defined by the retractable boom being disposed in its lowered operating position. The other limit of movement is defined as when the retractable boom with the boom extension attached thereto has been raised to a point where the combined load on the boom hoist ropes for lifting the retractable boom and boom extension combination is approximately equal to the load which would be imposed on the boom hoist ropes without the boom extension attached to the outboard end of the retractable boom. The supplemental lift force of the counterweight permits the existing boom hoist machinery arrangement to be able to lift the retractable boom with the extension attached without redesign or replacement.

Usually two counterweights 69 are used disposed on opposite sides of the gantry, and they are connected to the retractable boom 13 by auxiliary hoist ropes 71 disposed on and attached to opposite sides of the landside crane legs. The counterweights are guided by tracks in a specific predetermined limited vertical path on opposite sides of the grantry. The counterweights are restricted in their downward movement to stop when the load in the boom hoist ropes during retraction or lowering of the boom and extension combination approximates the load as if there were no extension boom secured to the retractable boom.

Figure 4:
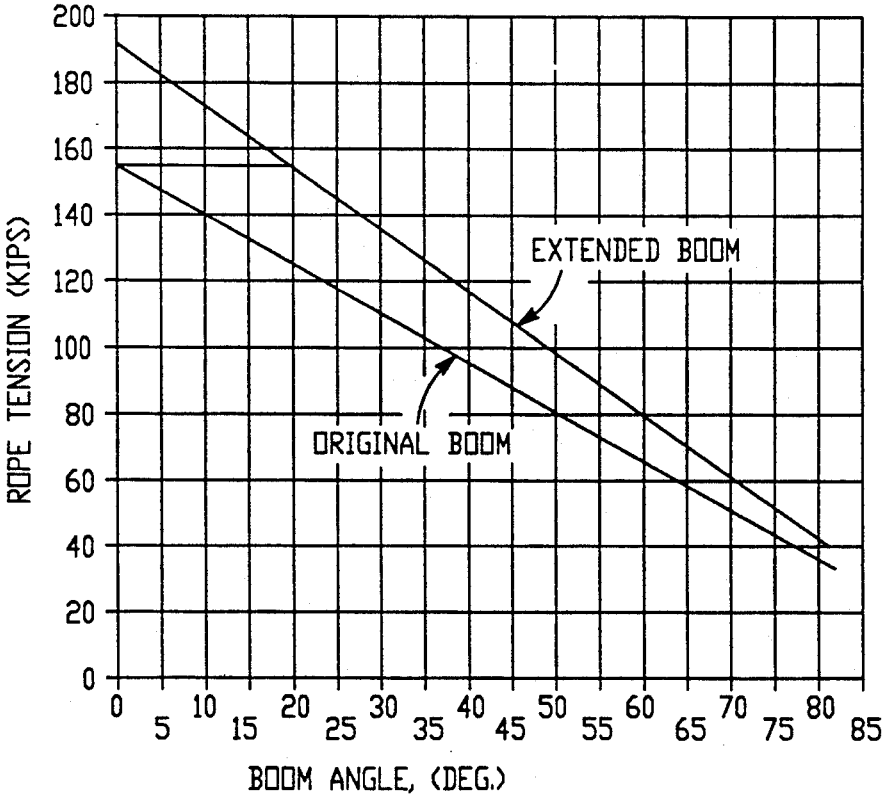
FIG. 4 is a graph of a typical gantry crane illustrating the boom hoist rope tension versus boom angle for the boom and extension.

A load diagram can be constructed to show the loading on the boom hoist ropes 23 as the retractable boom 13 is raised or lowered. Reference is made to FIG. 4 of the drawings. Thereshown is a graph of a typical gantry crane having a retractable boom which plots boom hoist rope tension versus boom angle. The lower line illustrates the rope loading caused by the original boom without the boom extension attached while the upper line illustrates the heavier loading caused by the boom with the boom extension secured thereto. Commencement of retraction imposes the heaviest loading on the boom hoist ropes. The load constantly decreases in the boom hoist ropes as the boom is raised, and at some point in the cycle, the load on the boom hoist ropes raising the retractable boom and boom extension combination reduces to and is equal to the same load as would be imposed on the boom hoist ropes at the commencement of boom retraction when raising the retractable boom without the extension attached thereto. That point is determined by where the horizontal line, which commences at the top of the lower line, intersects the upper line. At the boom angle which correlates to the intersection point, the load in the lift ropes has reduced to the load at the commencement of lift of the original boom without the extension. When the load decreases to that point during the lift cycle of the combination boom, the effect of the counterweights 69 is no longer needed to augment the lifting force for raising the added weight of the boom combination because the original lifting capacity of the boom hoist apparatus can handle the combined load for the remainder of the cycle. The effect of the counterweights is therefore removed from the system at that point in the hoist cycle by allowing the counterweights to come to rest against stops.

During the last portion of the lowering cycle, as the load of the combination retractable boom and boom extension on the boom hoist ropes 23 increases, the counterweights 69 are lifted off their stops when the load on the hoist ropes is approximately equal to the load on the hoist ropes at the commencement of boom retraction without the boom extension attached to the outboard end of the retractable boom. With this supplementary lifting force for part of the lifting/lowering cycle, effected by the counterweights and auxiliary boom hoist ropes, the original boom hoist machinery capacity does not need to be augmented when retrofitting a boom extension to a gantry crane thereby greatly simplifying the conversion procedure and eliminating the need for additional power requirements.

The counterweights 69 in the preferred invention are a pair of vertically slidable counterweights mounted on the crane's landside legs. The counterweights are provided with safety devices to prevent a runaway counterweight if a rupture or separation in the anchoring means were to occur. Counterweight support platforms 73 are disposed at the lowest point of the counterweight vertical travel to limit the motion of the counterweights after the extended retractable boom 13 has traveled past a preselected point in the retraction powering cycle. The tracks on which the counterweights reciprocate restrain the length and direction of motion which each counterweight can experience. Installation of these tracks is accomplished on the existing crane at convenient locations, usually on the vertical legs. In addition to supporting the load on the hoist ropes, these counterweights, by being located at the landside edge of the crane superstructure, also help in part to counterbalance the tipping torque caused by the addition of the extension boom section. They likewise help counterweight the additional tipping torque exerted by the suspended load being disposed at a greater distance from the crane superstructure on the extended boom section as well as provide stability for the crane in its operating mode.

An auxiliary forestay 75 is provided to carry the load of the boom extension. It extends between the top of the gantry superstructure and an intermediate connection 79 on the boom extension. Flexible forestays are used to support the boom extension because they can be guided as they relax so that they do not interfere with other portions of the crane structure when the retractable boom and the boom extension combination have been raised to the retracted position or lowered to the boom's horizontal position. The auxiliary forestays are anchored at each of their inboard ends at the top cross-tie beam 47 of the crane superstructure. The lower outboard ends of the forestays are secured to the upper chordal members of the boom extension section.

At least one auxiliary boom hoist rope 71 is secured between the retractable boom and boom extension combination and the counterweights 69. In practice, separate auxiliary boom hoist ropes are supplied for each counterweight. These auxiliary boom hoist ropes pass over sheaves 79 mounted on the crane superstructure 15 at a point above the vertical location of the retractable 13 boom whereby the auxiliary boom hoist ropes transmit a counterbalancing force on the retractable boom and boom extension combination while the retractable boom is being raised or lowered and the counterweights are raised above their lower limits. In the preferred embodiment, the sheaves for the auxiliary boom hoist ropes are located on the crane superstructure at or above the elevation of the sheaves which guide the original boom hoist ropes 23. In practice, a bridge is constructed on the cross-tie beam 47 at the top of the superstructure and the sheaves are mounted thereon above the boom hoist sheaves.

The counterweights and auxiliary boom hoist ropes and sheaves constitute a supplemental hoist mechanism for any gantry crane having a retractable boom which can be pivoted upward by boom hoist ropes about its inboard end at its attachment point to the crane superstructure. The limited movement of the counterweights causes the auxiliary boom hoist ropes to transmit a counterbalancing force on the retractable boom while it is being raised or lowered. This counterbalancing force is supplied at least while the combined load on the original boom hoist ropes and the auxiliary hoist ropes is equal to or greater than a preselected load on the original boom hoist rope below which the effect of the counterweights is removed from the system when these counterweights come to rest against their respective support platforms.

The present invention also contemplates the method of providing a boom extension retrofit for the gantry crane which can be implemented without removing the retractable boom from the crane and without requiring additional lift capacity in the existing boom hoist machinery or the boom hoist ropes utilized for retracting the boom. It comprises securing a new section of boom to the outboard end of the retractable boom with a means which does not add bending moment to the retractable boom, supporting the boom extension by additional forestay and supporting the additional load imposed by the boom extension on the boom hoist machinery and hoist ropes by a counterweight connected to the retractable boom and boom extension combination by an auxiliary boom hoist rope reeved over a sheave mounted on the crane superstructure at a point above the vertical location of the retractable boom on the superstructure, and stopping movement of the counterweight when the load imposed on the hoist ropes approximates the load when the retractable boom is pivoted upward about its inboard end.

The present invention also contemplates the method for retrofitting a boom extension to a gantry crane without imposing any appreciable bending moment on the retractable boom when the boom extension is carrying a load. The method comprises securing a new section of boom to the outboard end of the retractable boom with a pivot connection which permits the boom extension to rotate downward slightly from the horizontal operating position of the retractable boom when the boom extension is carrying a load, supplying stops to prevent the boom extension from rotating upward with respect to the retractable boom beyond a preselected limit, and supporting the boom extension by additional forestays to carry the vertical load thereof.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A boom extension for a gantry crane having a retractable boom which in its operating position extends outboard from the crane superstructure in a horizontal orientation and which can be pivoted about its inboard end at its attachment point to said superstructure by boom hoist ropes to an upward projecting retracted position, the boom extension comprising a section of boom secured to the outboard end of said retractable boom as a boom extension, said section being secured to said boom with means which do not add bending moment to the retractable boom, a forestay secured between said crane superstructure and said boom extension to carry the vertical load thereof, a counterweight mounted on said crane superstructure and formed to reciprocate between limits, one limit being defined as when the retractable boom is disposed in its lowered operating position and the other limit being defined as when the retractable boom with the boom extension attached thereto has been raised to a point where the load on the boom hoist ropes for lifting the retractable boom and boom extension combination is approximately equal to the load which would be imposed on the boom hoist ropes alone at the commencement of boom retraction without the boom extension attached to the outboard end of the retractable boom, and at least one auxiliary boom hoist rope secured between said retractable boom and boom extension combination and said counterweight and being reeved over a sheave mounted on said crane superstructure at a point above the vertical location of the retractable boom on said superstructure whereby said auxiliary hoist rope provides a lift force on said retractable boom and boom extension combination while said retractable boom is being raised or lowered and said counterweight is rised above its lower limit.

2. The boom extension of claim wherein the boom hoist ropes are reeved over sheaves mounted on said crane superstructure above said retractable boom and the sheave for said auxiliary boom hoist rope is located on said superstructure at or above the elevation of the sheaves which guide the boom hoist ropes.

3. The boom extension of claim 1 wherein the counterweight is comprised of two elements disposed on opposite sides of the boom and arranged to move generally up and down between stops on tracks secured to said crane superstructure.

4. The boom extension of claim 1 wherein said boom extension is secured to said retractable boom with a pivot connection which permits the boom extension to rotate downward slightly from the horizontal operating position of the retractable boom when the boom extension is carrying a load, a forestay is provided to carry the vertical load of the boom extension, and stops are provided to prevent said boom extension from rotating upward with respect to said retractable boom beyond a preselected limit.

5. A boom extension for a gantry crane having a retractable boom which in its operating position extends outboard from the crane superstructure in a horizontal orientation and which can be pivoted about its inboard end at its attachment point to said superstructure by boom hoist ropes to an upward projecting retracted position, said boom hoist ropes being reeved over sheaves mounted on said superstructure above said retractable boom, the boom extension comprising a section of boom secured to the outboard end of said retractable boom as a boom extension with a pivot connection which permits the boom extension to rotate downward slightly from the horizontal operating position of the retractable boom when the boom extension is carrying a load, a forestay to carry the vertical load of the boom extension, stops to prevent said boom extension from rotating upward with respect to said retractable boom beyond a preselected limit, a counterweight mounted to said crane superstructure and disposed to move generally up and down between stops on tracks secured to said superstructure, one stop being defined as when the retractable boom is disposed in its lowered operating position and the other stop being defined as when said retractable boom and boom extension combination has been raised to a point where the load on the boom hoist ropes for lifting the retractable boom and boom extension combination is approximately equal to the load which would be imposed on the boom hoist ropes alone at the commencement of boom retraction without the boom extension attached to the outboard end of the retractable boom, and at least one auxiliary boom hoist rope secured between said retractable boom and boom extension combination and said counterweight and passing over a sheave mounted on said crane superstructure at or above the elevation of the sheaves which guide the boom hoist ropes.

6. The boom extension of claim 5 wherein the pivot connection which permits the boom extension to rotate downward slightly from the horizontal operating position of the retractable boom is disposed between the lower outboard end of the retractable boom and the lower inboard end of the boom extension whereby said boom extension can rotate downward around a horizontal axis disposed perpendicular with respect to the longitudinal axis of the retractable boom, and the upper inboard ends of the boom extension are provided with abutment stops which are formed to bear against similar abutment stops formed on the upper outboard end of the retractable boom.

7. The boom extension of claim 5 wherein said forestay supporting said boom extension is flexible and does not mechanically interfere with the operation of other parts of the gantry crane when said retractable boom and boom extension combination have been raised to the retracted position.

8. A boom extension for a gantry crane having a retractable boom which in operating position extends outboard from the crane superstructure in a horizontal orientation and which can be pivoted about its inboard end at its attachment point to said superstructure by boom hoist ropes to an upward projecting retracted position, said boom hoist ropes being reeved over sheaves mounted on said superstructure above said retractable boom, the boom extension comprising a section of boom secured to the outboard end of said retractable boom as a boom extension with a pivot connection disposed between the lower outboard end of the retractable boom and the lower inboard end of the boom extension whereby said boom extension can rotate downward around a horizontal axis disposed perpendicular with respect to the longitudinal axis of the retractable boom, abutment stops disposed at the upper inboard ends of the boom extension which are formed to bear against similar abutment stops formed on the upper outboard end of the retractable boom, a flexible forestay to carry the vertical load of the boom extension which does not mechanically interfere with the operation of other parts of the gantry crane when said retractable boom and boom extension combination have been raised to the retracted position, a pair of counterweights mounted to said crane superstructure on opposite sides of the boom and disposed to move generally up and down between stops on tracks secured to said superstructure, one stop being defined as when the retractable boom is disposed in its lowered operating position and the other stop being defined as when said retractable boom and boom extension combination has been raised to a point where the load on the boom hoist ropes for lifting the retractable boom and boom extension combination is approximately equal to the load which would be imposed on the boom hoist ropes alone at the commencement of boom retraction without the boom extension attached to the outboard end of the retractable boom, and a pair of auxiliary boom hoist ropes secured between said retractable boom and boom extension combination and said counterweights and passing over sheaves mounted on said crane superstructure at or above the elevation of the sheaves which guide the boom hoist ropes.

9. A supplemental hoist mechanism for a gantry crane having a retractable boom which can be pivoted upward by boom hoist ropes about its inboard end at its attachment point to the crane superstructure to an upward projecting retracted position, said mechanism being formed to permit said retractable boom with a boom extension secured to the outboard end thereof to be hoisted by said boom hoist ropes and the associated boom hoist drive machinery provided for hoisting said retractable boom without said boom extension attached thereto, the invention comprising a movable counterweight mounted on said gantry crane, the travel of said counterweight being limited whereby its effective force is dissipated when the combined load on the boom hoist ropes and auxiliary boom hoist rope is approximately equal to the load which would be imposed on the boom hoist ropes alone if said boom extension was not attached to the outboard end of said retractable boom, and an auxiliary boom hoist rope mounted on said crane and connected between said counterweight and said retractable boom and boom extension combination, said auxiliary hoist rope being reeved over a sheave mounted on said crane superstructure at a point above the vertical location of the retractable boom on said superstructure whereby said auxiliary hoist rope provides a lift force to said retractable boom while said combination boom is being raised or lowered, said lift force being supplied by said counterweight through said auxiliary hoist rope at least while the combined load on the boom hoist ropes and auxiliary hoist rope is approximately equal to or greater than the load on the boom hoist ropes alone at the commencement of boom retraction without the boom extension attached to the outboard end of said retractable boom.

10. The method of providing a boom extension retrofit for a grantry crane having a retractable boom which in operating position extends outboard from the crane superstructure in a horizontal orientation and which can be pivoted about its inboard end at its attachment point to said superstructure by boom hoist ropes, said method being implementable without removing the retractable boom from the crane and without requiring additional lift capacity in the boom hoist drive machinery or the boom hoist ropes utilized for retracting said boom, said method comprising securing a section of boom to the outboard end of said retractable boom with means which do not add bending moment to the retractable boom, supporting said boom extension by additional forestays to carry the vertical load thereof, and supporting the additional load imposed by said retractable boom and boom extension combination on said boom hoist ropes by a movable counterweight connected to said retractable boom and boom extension combination by an auxiliary boom hoist rope reeved over a sheave mounted on said crane superstructure at point above the vertical location of the retractable boom on said superstructure.

11. The method of claim 10 including limiting the movement of said counterweight between predetermined stops, one stop being defined by the retractable boom being disposed in its lowered operating position and the other stop being defined as when the retractable boom with the boom extension attached thereto has been raised to a point where the load on the boom hoist rope for lifting the retractable boom and boom extension combination is approximately equal to the load which would be imposed on the boom hoist ropes alone at the commencement of boom retraction without the boom extension attached to the outboard end of the retractable boom.

12. A method for retrofitting a boom extension to a gantry crane having a retractable boom which in its operating position extends outboard from the crane superstructure in a horizontal orientation, said method permitting said boom extension to be added to said boom without imposing any appreciable bending movement on said boom when said boom extension is carrying a load, the method comprising securing a section of boom to the outboard end of said boom with a pivot connection which permits the boom extension to rotate downward slightly from the horizontal operating position of said boom when said boom extension is carrying a load, supplying stops to prevent said boom extension from rotating upward with respect to said boom beyond a preselected limit, and supporting said boom extension by additional forestays to carry the vertical load thereof.

* * * * *